US005679471A

United States Patent [19]

Cheng et al.

[11] Patent Number: 5,679,471

[45] Date of Patent: Oct. 21, 1997

[54] SILVER-NICKEL NANO-COMPOSITE COATING FOR TERMINALS OF SEPARABLE ELECTRICAL CONNECTORS

[75] Inventors: Yang-Tse Cheng, Rochester Hills, Mich.; George Albert Drew, Warren, Ohio

[73] Assignee: General Motors Corporation, Detroit, Mich.

[21] Appl. No.: 543,660

[22] Filed: Oct. 16, 1995

[51] Int. Cl.[6] ..... H01H 1/02

[52] U.S. Cl. ..... 428/673; 428/929; 428/938; 200/266; 200/267

[58] Field of Search ..... 428/614, 673, 428/929, 938; 200/266, 265, 267; 439/886, 887

[56] References Cited

U.S. PATENT DOCUMENTS

| | | | |
|---|---|---|---|
| 3,226,517 | 12/1965 | Schreiner | 200/266 |
| 3,648,355 | 3/1972 | Shida et al. | 29/471.7 |
| 3,882,587 | 5/1975 | Schneider et al. | 29/419 R |
| 4,162,160 | 7/1979 | Witter | 200/266 |
| 4,529,667 | 7/1985 | Shiga et al. | 428/646 |
| 4,699,763 | 10/1987 | Sinharoy et al. | 419/11 |
| 4,834,939 | 5/1989 | Bornstein | 419/21 |
| 5,045,349 | 9/1991 | Ferrando | 427/113 |
| 5,139,890 | 8/1992 | Cowie et al. | 428/670 |
| 5,246,480 | 9/1993 | Haufe et al. | 75/236 |
| 5,416,292 | 5/1995 | Behnke et al. | 200/19 R |
| 5,500,304 | 3/1996 | Loffler et al. | 428/614 |

FOREIGN PATENT DOCUMENTS

| | | | |
|---|---|---|---|
| 60-34764 | 8/1985 | Japan | 200/266 |

OTHER PUBLICATIONS

E. M. Wise, "Electrical Contacts", The International Nickel Co., Inc., NY, NY, OSRD No. 5163, Serial No. M-499, pp. 36-37 and 94 May 1945.

"Fansteel Electrical Contacts Engineering Information", Fansteel Metallurgical Corp., North Chicago, Illinois, pp. 11-12, 20-21 and 26 1950.

*Primary Examiner*—John Zimmerman

*Attorney, Agent, or Firm*—George A. Grove

[57] ABSTRACT

A thin film silver-nickel coating for use as a protective coating on electrical terminals of separable electrical connectors. The silver-nickel coating is a silver-nickel nano-composite material characterized by silver and nickel grains having an average grain size of about five to about fifty nanometers, yielding a silver-rich phase and a harder nickel-rich phase as a result of silver and nickel being immiscible. In accordance with this invention, the volume fraction of nickel significantly influences the fretting wear resistance of the coating, with a preferred nickel content being resulting in the presence of disconnected islands of the nickel phase dispersed within a relatively softer silver matrix.

11 Claims, 3 Drawing Sheets

SILVER-NICKEL NANO-COMPOSITE COATING FOR TERMINALS OF SEPARABLE ELECTRICAL CONNECTORS

The present invention generally relates to electrical terminals for separable electrical connections. More particularly, this invention relates to a silver-nickel nano-composite coating material for such electrical terminals in which the coating material is characterized by silver-rich and nickel-rich phases and exhibits enhanced high temperature and electrical contact properties as well as suitable corrosion resistance and frictional properties.

BACKGROUND OF THE INVENTION

The electrical content of automobiles is continually increasing, corresponding to a demand for reliable, economical and environmentally-benign electrical connectors. Basic requirements for the electrical contacts of such connectors include a minimal engagement force between the mating terminal components, low contact resistance through high contact forces and environmentally-resistant materials, and the capability for multiple engagements through the use of wear-resistant materials.

Copper and its alloys are primarily used to form the current-carrying components of connects. However, copper is prone to oxidation, which significantly increases the electrical resistance across the mating contact surfaces. Therefore, to achieve the above requirements, various coatings have been proposed for electrical contacts that serve to enhance the electrical conductivity and the temperature, chemical and wear resistance of the contact surfaces. A commonly-used coating material in the automotive industry is electroplated tin. However, tin coatings generally limit their electrical connectors to temperatures of about 125° C. due to the tendency for interdiffusion, which causes bonding of the mating contact surfaces, alloy formation at the tin-substrate interface and oxidation of the contact surfaces. As engine compartments become more compact, the relative number of underhood applications that are incompatible with tin-coated contacts is increasing. Another disadvantage with tin-coated contacts is their relatively high friction coefficient, which can cause difficulties during the assembly of multi-pin connectors.

While gold coatings on the order of about one to three micrometers have been used successfully for high temperature applications, its material cost is generally prohibitive for many products. Consequently, there is a demand for lower-cost coating materials that are adapted for automotive use. Electroplated silver has been widely identified as a high temperature coating material for electrical connector applications and is economically practical if employed in the form of a sufficiently thin layer. However, silver coatings are not highly resistant to corrosion and are generally characterized by a high coefficient of friction—on the order of about one for silver on silver. Furthermore, thin electroplated silver coatings are relatively soft and are therefore prone to erosion from multiple engagements of the contact surfaces of a connector. Though the above shortcomings exist, the prior art has suggested various coating systems that employ silver and its alloys as the contact surface for high temperature applications, employing intermediate layers to promote the integrity of the silver layer. For example, U.S. Pat. No. 4,529,667 to Shiga et al. teaches a three-layer electroplated coating system comprising a bottom layer of a nickel, cobalt, chromium or palladium alloy, an intermediate layer of a tin, cadmium, palladium or ruthenium alloy, and a top layer of a silver alloy. Another example of an electroplated coating system is taught by U.S. Pat. No. 5,139,890 to Cowie et al., involving a nickel, iron or chromium barrier layer between a silver coating and a copper substrate.

As can be seen by the teachings of the above, coating materials for electrical contacts often entail electroplated coating materials and systems. Though electroplated coatings are used for mass production of connector components, there is a concerted effort to avoid the use of electroplating techniques in view of the environmentally hazardous byproducts used in the plating baths. Furthermore, electroplating methods cannot easily be used to form multiple layer structures, composites and amorphous alloys of metals and ceramics. Consequently, other coating methods have been proposed in the prior art, including the use of bonded layers such as the palladium, silver alloy and nickel-copper alloy system taught by U.S. Pat. No. 3,648,355 to Shida et al. However, the requirement to handle, assemble and bond individual layers render such methods ill-suited for many mass-produced components.

Though various coating materials for use in computer-related electronics have been proposed, such materials have generally been inadequate for use in the harsh environment of an automobile. Therefore, it would be desirable to provide a coating system for the terminals of separable electrical connectors, in which the coating system provided the low contact resistance, thermal stability and low friction coefficient of silver coating systems, but with enhanced reliability and wear resistance. It would be particularly desirable if such a coating system could be formed without the use of electroplating or bonding techniques, but instead employed a deposition technique that enabled the coating system to be carefully tailored for optimal performance in an automotive environment.

SUMMARY OF THE INVENTION

It is an object of this invention to provide a coating system for electrical terminals of separable electrical connectors.

It is another object of this invention that such a coating system include silver as a constituent, such that the coating system is characterized by low contact resistance, thermal stability and low friction, and therefore yields an electrical terminal suitable for use in a high temperature automotive environment.

It is yet another object of this invention that such a coating system be further characterized by sufficient wear resistance in order to enable the terminals to survive numerous engagements.

It is a further object of this invention that such a coating system be deposited by a vapor deposition technique that enables the chemistry of the coating system to be carefully tailored to achieve a desired ratio between coating constituents.

In accordance with a preferred embodiment of this invention, these and other objects and advantages are accomplished as follows.

According to the present invention, there is provided a thin film silver-nickel coating for use as a protective coating on electrical terminals of separable electrical connectors. In particular, the silver-nickel coating is a silver-nickel composite material characterized by a silver-rich phase and a harder nickel-rich phase, as a result of silver and nickel being immiscible. In accordance with this invention, the volume fraction of nickel significantly influences the fretting wear resistance of the coating, with a preferred nickel content resulting in the presence of disconnected islands of the nickel phase dispersed within a relatively softer silver matrix.

Other aspects of the coating that achieve and/or promote the objects of the invention include forming the coating using a vapor deposition technique, such that the silver-nickel composite material is characterized as a nanocomposite material, with the nickel and silver phases having an average grain size of about five to about fifty nanometers. The vapor deposition technique of this invention enables the formation of the desired nanocomposite structure, which is otherwise impossible with known electroplating techniques. Furthermore, the deposition technique enables the coating to be deposited on a wide variety of substrates, including steel, and is not encumbered by the use of environmentally hazardous products and byproducts.

According to this invention, a significant advantage of the silver-nickel composite coating is that it is particularly well suited for use as an electrical terminal coating in the harsh environment of an automobile. In particular, the coating is highly resistant to fretting wear, while also exhibiting low contact resistance, a low coefficient of friction, and high thermal stability when exposed to temperatures in excess of about 150° C.

Another advantage of the invention is that the composite coating is uniquely achieved by a deposition process that enables the coating to be carefully tailor 1 for optimal performance in an automotive environment, while simultaneously avoiding hazardous aspects of prior art coating methods. In addition, the vapor deposition process of this invention is highly suited for depositing a uniform coating on continuous lengths of metal strip and is therefore compatible with existing stamping and manufacturing processes employed in the production of electrical terminals.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE INVENTION

Figure 1:
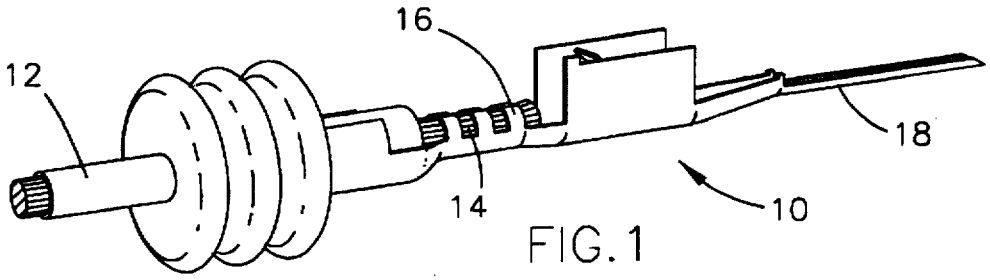
FIG. 1 represents an electrical terminal of a type suitable for implementation of a silver-nickel composite coating in accordance with the present invention.

The present invention is a silver-nickel composite coating system for an electrical terminal connector 10 of a type represented in FIG. 1. As shown, the connector 10 is a male terminal configured to be attached to an electrical cable 12 encasing wire strands 14. A portion 16 of the connector 12 is crimped to secure and electrically connect the wire strands 14 to the connector 10. At the opposite end of the connector 10 there is formed a tongue 18 adapted to be received in a receptacle formed by a corresponding female terminal (not shown) in accordance with conventional practice. The teachings of this invention are applicable to terminal configurations other than that shown in FIG. 1, as will become apparent with the following discussion of the invention.

For use as a separable connection in an automotive environment, the surfaces of the tongue 18 and the mating surfaces of the female terminal should preferably exhibit low contact resistance, a low coefficient of friction, wear resistance and thermal stability at temperatures in excess of about 150° C. According to this invention, the silver-nickel composite coating system to be described below fulfills these requirements. As a composite, the coating system is not an alloy composition, but instead is characterized by distinct, coexisting phases. More specifically, the coating system consists of two phases, a silver-rich phase and a nickel-rich phase, each of which are predominantly composed of their dominant constituent, with the remainder being primarily the other constituent. In addition, the silver-rich and nickel-rich phases are nanocrystalline, having an average grain size on the order of about five to about fifty nanometers, with a suitable average grain size being about ten nanometers.

The nickel-rich phase is relatively hard and preferably exists as disconnected islands dispersed within a matrix formed by the softer silver-rich phase. This latter aspect is achieved by maintaining the volume fraction of nickel below its percolation threshold in silver, which is about 27 volume percent. Particularly suitable composite coatings are silver-rich, having compositions containing about 17 to about 20 atomic percent nickel, though substantially higher and lower nickel contents are within the scope of this invention.

According to this invention, the nanocrystalline structure for the composite coating system is achieved by a vapor deposition process, such as by electron beam evaporation, and therefore differs from any microstructure producible using electroplating techniques. Through vapor deposition, silver and nickel can be readily co-deposited on a wide variety of substrate materials to thicknesses of up to about 8000 nanometers and more, with a suitable thickness being about 100 to about 500 nanometers for the composite coating of this invention.

The preferred composite coatings of this invention can generally be deposited in accordance with the following. Deposition can be carried out by electron beam evaporation under an ultrahigh vacuum using equipment of the type known in the art. Preferred source materials for the process are 99.999 percent pure silver and 99.99 percent pure nickel located in two separate electron beam evaporation sources. As noted above, various substrates can be coated by vapor deposition, with particularly suitable materials for electrical terminals including copper alloys and steels. AISI Type 301 stainless steel is particularly well suited for use with this invention as a relatively low cost material having desirable high temperature properties.

Prior to deposition, the substrates are cleaned in a conventional manner, such as in an ultrasonic bath and/or with solvents such as acetone and methanol. The substrates are then placed within the deposition chamber of the vapor deposition system, with the pressure within the chamber being preferably maintained at not more than about $1\times10^{-8}$ torr to ensure a high purity for the vapor deposited composite coating. The surfaces of the substrates may be sputter cleaned prior to deposition using 100 eV $Ar^+$ ions with a beam current density of about one milliamp per square centimeter for five minutes, as such a technique has been found to enhance adhesion between vapor deposited films and their substrates.

Finally, a silver-nickel composite coating is obtained by evaporating silver and nickel simultaneously from the two electron beam evaporator sources. Deposition can generally be performed at near room temperature and controlled to occur at a rate of a few tenths of a nanometer per second using standard monitoring equipment known in the art. Importantly, the deposition rates from the different silver and nickel sources are controlled to attain the desired composition for the composite coating. In this manner, the thickness and composition of the composite coating can be advantageously controlled to within about five percent. A total impurity level for oxygen and carbon of less than about two atomic percent can typically be achieved with this deposition process.

Figure 2:
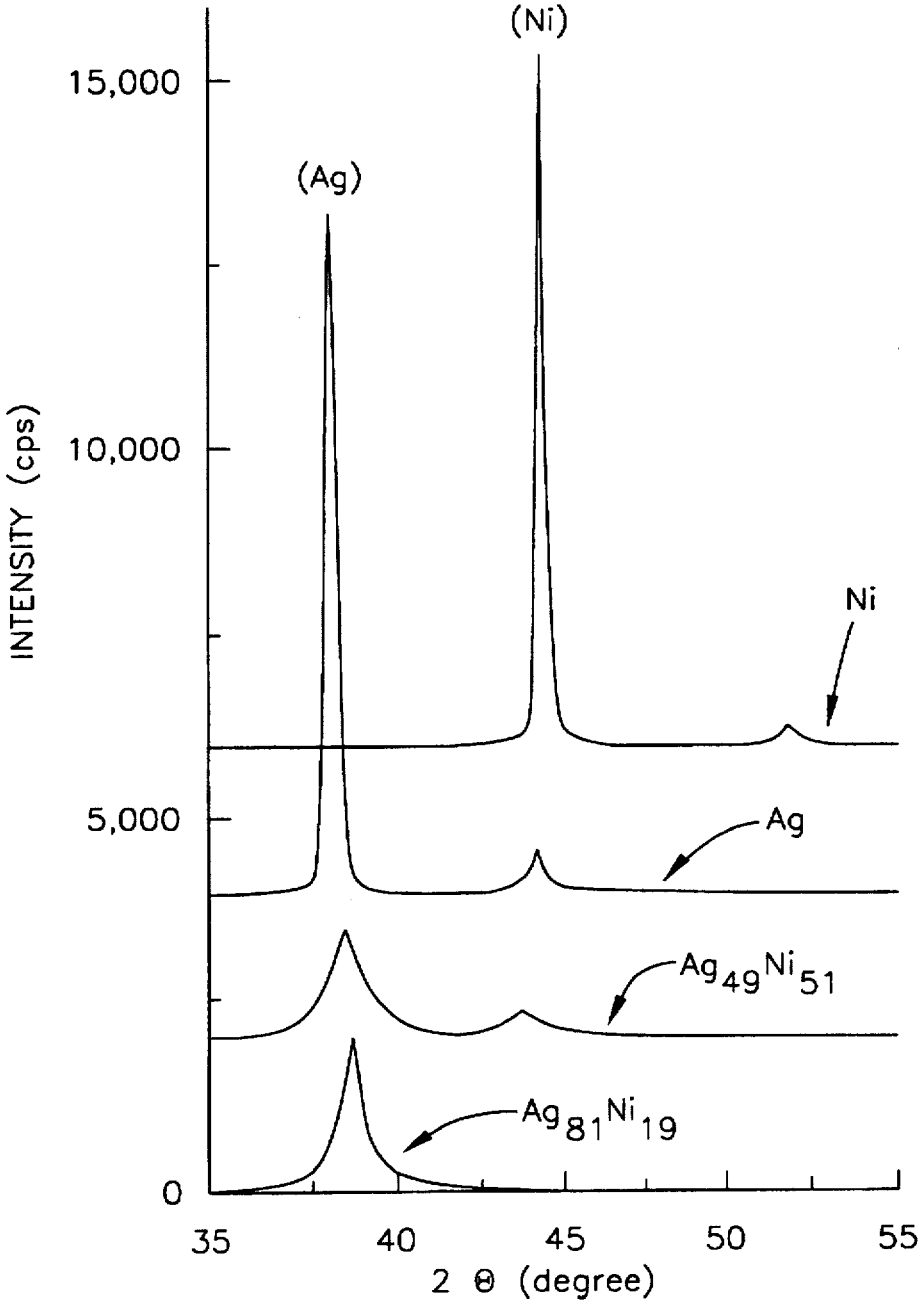
FIG. 2 shows x-ray diffraction results of nickel, silver and silver-nickel composite thin films.

For evaluation, silver-nickel composite coatings having the atomic compositions $Ag_{49}Ni_{51}$ and $Ag_{81}Ni_{19}$ were deposited onto identical Type 301 substrates in accordance with the above, as were substantially pure silver and nickel coatings for purposes of comparison. Coating thicknesses for the silver-nickel composite coatings were controlled to about 500 nanometers, though thin film coatings generally on the order of about 100 to about 8000 nanometers are generally suitable, and significantly thinner and thicker coatings are within the scope of this invention. X-ray diffraction results of the silver-nickel composite, silver and nickel coatings are represented in FIG. 2. The two broad diffraction peaks in the diffraction pattern for the $Ag_{49}Ni_{51}$ composition evidences that this coating is characterized by a silver-rich phase and a nickel-rich phase, rather than a single, face-centered-cubic (fcc) solid solution. Further analysis indicated the silver-rich phase to be about 92 atomic percent silver, and the nickel-rich phase to be about 90 atomic percent nickel. The grain size for both the silver and nickel-rich phases was about nine nanometers.

Similarly, the $Ag_{81}Ni_{19}$ composition was characterized by silver-rich and nickel-rich phases, though the second diffraction peak for the nickel-rich phase was small and only observable in a log (intensity) versus angle plot. Analysis of this sample indicated the silver-rich phase to be about 89 atomic percent silver, with an average grain size of about 13 mm. The diffraction peak for the nickel-rich phase was too weak for accurate determination of either purity or grain size, though a purity and grain size comparable to the silver-rich phase would be expected for the nickel-rich phase.

From the above, it can be seen that nanocrystalline composites having both silver-rich and nickel-rich phases were successfully achieved by co-deposition of silver and nickel onto a Type 301 stainless steel. While composites of silver and nickel can be achieved by powder metallurgy techniques, such techniques have not yielded the nanocrystalline composite microstructure achieved by this invention. Furthermore, powder metallurgy techniques are not capable of developing sufficiently thin coatings directly on substrates such as electrical terminals. The formation of the nanocrystalline composites of silver and nickel can be understood based on thermodynamic and kinetic considerations. Silver and nickel are mutually insoluble in thermodynamic equilibrium. When silver and nickel atoms are deposited onto a substrate simultaneously, phase separation is expected. However, because atomic diffusion is limited at low substrate temperatures, such as about 25° C, the size of the phase-separated region is small and some degree of solute trapping can produce supersaturated solid solution, as observed in FIG. 2.

The suitability of the silver-nickel composite coatings described above for use as terminal coatings of separable electrical connections was evaluated on the basis of coefficient of friction, resistance to fretting wear and thermal stability.

Coefficient of friction measurements were made with a fixture utilizing a load cell mounted on a balance arm for measuring friction forces. Tests were conducted on unlubricated samples with a contact force of about two Newtons, a track length of about four millimeters, and a sliding speed of about one millimeter per second. Samples of the $Ag_{49}Ni_{51}$ and $Ag_{81}Ni_{19}$ composite coatings exhibited a coefficient of friction of about 0.5, as compared to about 0.8 to 1.2 for bulk silver, about 0.7 for bulk nickel, and about 0.8 for bulk Type 301 steel. From this, it was apparent that silver-nickel composite coatings of this invention are capable of lower coefficients of friction than that of any of the individual coating constituents. Friction testing of the substantially pure silver coating noted above, which was also vapor deposited in accordance with this invention to achieve a nanocrystalline microstructure, indicated a coefficient of friction of about 0.2 to about 0.3, suggesting that the nanocrystalline microstructure achieved through vapor deposition significantly contributes to the frictional properties of the composite coatings of this invention.

Next, thermal stability testing was conducted by heat-aging silver-nickel composite coating specimens in air at about 150° C. for about 168 hours, and then testing the specimens for contact resistance and coefficient of friction. Contact resistance was measured per ASTM B667 with a probe having a solid gold rod with a 1.6 millimeter hemispherical radius as the probe tip. The pre-test coefficients of friction for the specimens was about 0.5, as noted above, while the contact resistances for the $Ag_{49}Ni_{51}$ and $Ag_{81}Ni_{19}$ specimens were about 6.0 and 5.0, respectively. Following heat-aging, the coefficients of friction for the $Ag_{49}Ni_{51}$ and $Ag_{81}Ni_{19}$ specimens were about 1.5 and 0.5, respectively, and the contact resistances for the $Ag_{49}Ni_{51}$ and $Ag_{49}Ni_{19}$ specimens were about 27.0 and 7.1, respectively.

Figure 4:
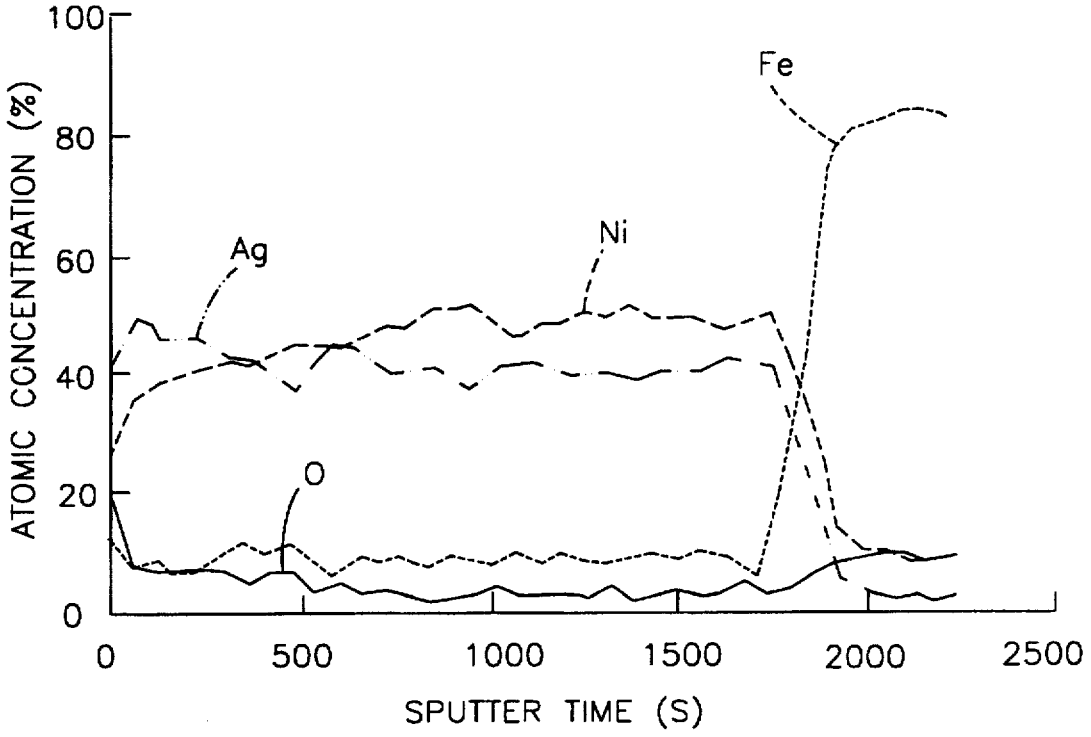
FIG. 4 shows an Auger sputter depth profile of a preferred silver-nickel composite coating material of this invention.

The above results indicated that the $Ag_{81}Ni_{19}$ specimens were more resistant to harsh thermal environments than the $Ag_{49}Ni_{51}$ specimens. SEM observations indicated the formation of particles on the originally smooth surfaces of the $Ag_{49}Ni_{51}$ specimens. The particles were apparently silver-covered nickel oxide particles, which would explain the higher contact resistance of the $Ag_{49}Ni_{51}$ specimens, and may also explain the higher coefficient of friction for these specimens. In contrast, SEM observations of the $Ag_{81}Ni_{19}$ specimens did not reveal any such formations, with the surfaces of the specimens remaining smooth and oxide-free. A sputter depth profile of the $Ag_{81}Ni_{19}$ composite specimen after the heat-aging test is presented in FIG. 4. From these observations, it was apparent that the resistance to oxidation was dependent on the amount of nickel in the composite, though the mechanism of oxidation resistance was not understood.

Finally, resistance to fretting wear was evaluated with a fixture similar to that used to determine coefficients of friction for the specimens. A dimple rider specimen with a 1.6 millimeter hemispherical radius was mounted on a balance arm loaded with a weight generating a contact force of about one Newton. Tests were conducted on unlubricated samples mounted to a precision stage driven by a computer-controlled stepping motor, which provided a stroke length of about 20 micrometers and a cycle rate of about eight hertz. The contact electrical resistance between the rider and the specimens was measured using a four-wire resistance method known in the art, with current limited to about 100 milliamps and the open circuit voltage limited to a maximum of about 20 millivolts. Contact resistance was periodically measured at discrete intervals along the length of the wear track over a duration of one million cycles.

Figure 3A:
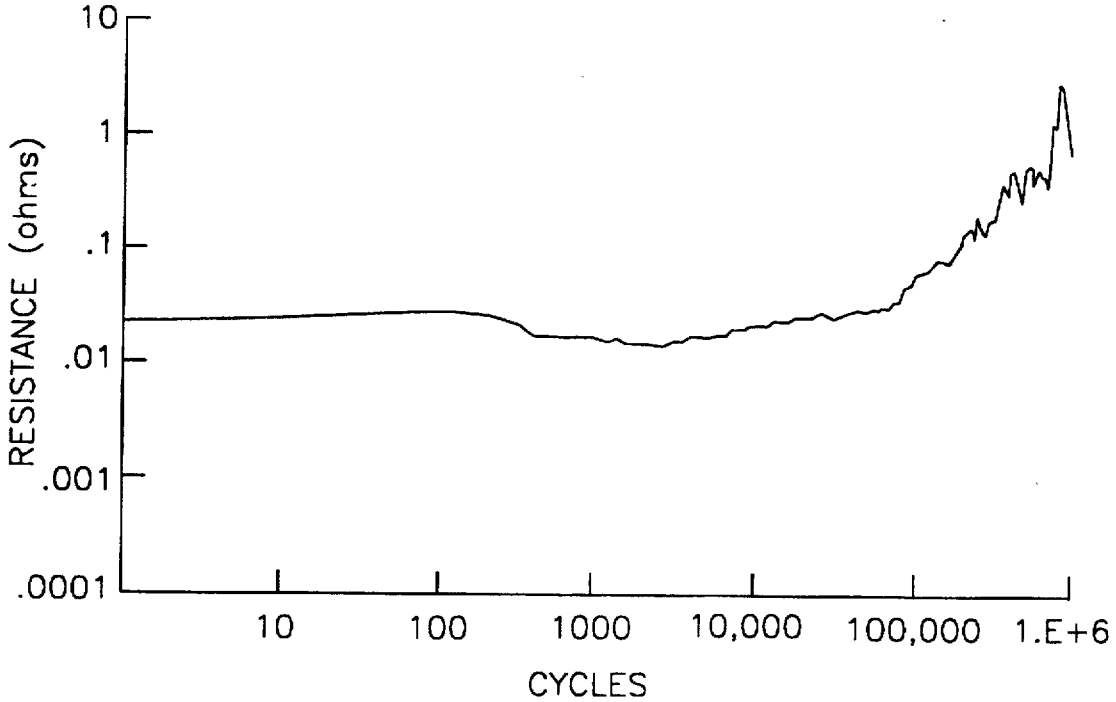
FIGS. 3A and 3B compare electrical resistance-fretting wear test results of two silver-nickel composite coating materials of this invention.
Figure 3B:
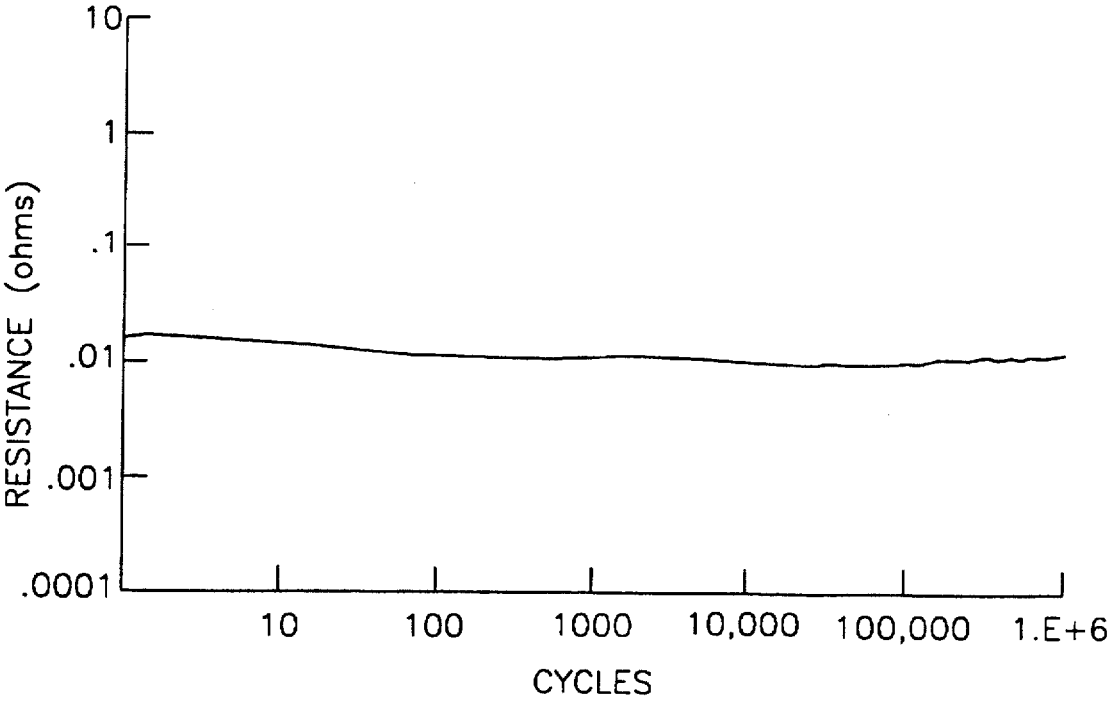

Results of the fretting wear tests on the $Ag_{49}Ni_{51}$ and $Ag_{81}Ni_{19}$ compositions are represented in FIGS. 3A and 3B, respectively. The contact resistance of the $Ag_{49}Ni_{51}$ specimen remained at less than 30 milliohms for 100,000 cycles, while the contact resistance for the $Ag_{81}Ni_{19}$ specimen remained at 20 milliohms or less for over one million cycles. From this, it was apparent that the fraction of silver-rich and nickel-rich phases can influence fretting wear resistance. While the 38 percent volume fraction of nickel in the $Ag_{49}Ni_{51}$ specimen was above the percolation threshold (27 volume percent) for nickel in silver, the volume fraction of the nickel in the $Ag_{81}Ni_{19}$ specimen was about 13 volume percent, and therefore below this threshold. Above the percolation threshold, the hard nickel phase forms a connected skeleton, while below the threshold, the hard nickel phase disperses into disconnected islands. The fretting wear tests illustrated that a composite coating with nickel islands embedded in a soft silver matrix had better fretting wear resistance than that of a silver-nickel composite having a connected nickel skeleton.

From the above, it can be seen that a significant advantage of this invention is that silver-nickel composite coatings can be formed in a manner that yields an electrical terminal coating that is particularly well suited for use in the harsh environment of an automobile. More specifically, silver-nickel composite coatings of the type disclosed herein are highly resistant to fretting wear, while also exhibiting low contact resistance, a low coefficient of friction, and high thermal stability. While a preference is apparent for silver-nickel composite coatings having a nickel volume fraction below the percolation threshold for nickel in silver, it is believed that silver-nickel composite coatings having a nanocrystalline grain size in accordance with this invention will exhibit superior electrical and wear properties as compared to electroplated silver and its alloys.

Another advantage of the invention is that a vapor deposition technique is identified as being capable of uniquely achieving the desired nanocrystalline microstructure for the silver-nickel composite coatings of this invention. Importantly, vapor deposition enables the thickness and composition of a silver-nickel composite coating to be carefully and precisely tailored for optimal performance in an automotive environment, while simultaneously avoiding hazardous aspects associated with prior art electroplating methods. In addition, vapor deposition processes in accordance with this invention are highly suited for depositing uniform coatings on continuous lengths of metal strip, and are therefore compatible with existing stamping and manufacturing processes employed in the production of electrical terminals.

It should be noted that while the silver-nickel composite coatings of this invention are described in terms of a coating for electrical terminals of separable electrical connections, the teachings of this invention could be employed in alternative applications. Furthermore, the silver-nickel composite coatings of this invention could be used with a barrier layer, such as a thin layer of nickel, on substrates prone to interdiffusion at high temperatures, such as tin, copper and their alloys.

Therefore, while this invention has been described in terms of a preferred embodiment, it is apparent that other forms could be adopted by one skilled in the art. For example, the deposition technique and processing parameters could be modified from those described, alternative substrate materials could be employed, and the composition of a silver-nickel composite could differ from those described. Accordingly, the scope of this invention is to be limited only by the following claims.

What is claimed is:

1. An electrical contact having a thin film coating of a silver-nickel composite material, the silver-nickel composite material being characterized by an average grain size of about five to about fifty nanometers.

2. An electrical contact as recited in claim 1 wherein the silver-nickel composite material consists essentially of a silver-rich phase and a nickel-rich phase.

3. An electrical contact as recited in claim 1 wherein the silver-nickel composite material has a nickel content of not more than a percolation threshold of nickel in silver.

4. An electrical contact as recited in claim 1 wherein the silver-nickel composite material is characterized by disconnected islands of a nickel phase dispersed in a relatively softer silver matrix.

5. An electrical contact as recited in claim 1 wherein the thin film coating is a vapor deposited coating.

6. An electrical contact as recited in claim 1 further comprising a steel substrate on which the thin film coating is present.

7. An electrical contact as recited in claim 1 wherein the silver-nickel composite material is characterized by an average grain size of about ten nanometers.

8. An electrical contact as recited in claim 1 wherein the thin film coating has a thickness of up to about 8000 nanometers.

9. An electrical contact comprising:

a substrate; and a thin film on the substrate the thin film consisting essentially of a silver-nickel composite material characterized by a nickel-rich phase dispersed in a relatively softer silver-rich phase, the silver-nickel composite material being further characterized by an average grain size of about five to about fifty nanometers and a nickel content of not more than about 27 volume percent.

10. An electrical contact as recited in claim 9 wherein the thin film is a vapor deposited coating.

11. An electrical contact as recited in claim 1 wherein the thin film coating has a thickness of about one hundred to about five hundred nanometers.

* * * * *